US007207142B2

(12) United States Patent
Mullet

(10) Patent No.: US 7,207,142 B2
(45) Date of Patent: Apr. 24, 2007

(54) SYSTEM AND RELATED METHODS FOR SIGNALING THE POSITION OF A MOVABLE BARRIER AND SECURING ITS POSITION

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/309,929

(22) Filed: Dec. 4, 2002

(65) Prior Publication Data

US 2004/0107639 A1 Jun. 10, 2004

(51) Int. Cl.
*E05F 11/00* (2006.01)

(52) U.S. Cl. ..... 49/199; 49/197; 340/686.1

(58) Field of Classification Search ..... 49/197, 49/199; 318/266, 434, 466, 467, 468; 340/686.1
See application file for complete search history.

(56) References Cited

U.S. PATENT DOCUMENTS

| | | | | |
|---|---|---|---|---|
| 4,408,146 | A | 10/1983 | Beckerman | 318/264 |
| 4,464,651 | A * | 8/1984 | Duhame | 340/521 |
| 4,583,081 | A | 4/1986 | Schmitz | 340/545 |
| 4,655,315 | A * | 4/1987 | Saville | 181/153 |
| 4,843,373 | A * | 6/1989 | Trickle et al. | 340/540 |
| 4,954,810 | A | 9/1990 | Llewellyn | 340/545 |
| 5,218,282 | A | 6/1993 | Duhame | 318/603 |
| 5,226,256 | A | 7/1993 | Fries et al. | 49/13 |
| 5,278,480 | A | 1/1994 | Murray | 318/626 |
| 5,402,105 | A | 3/1995 | Doyle et al. | 340/539 |
| 5,576,701 | A | 11/1996 | Heitschel et al. | 340/825.31 |
| 5,689,236 | A | 11/1997 | Kister | 340/545 |
| 5,798,681 | A * | 8/1998 | Chang | 336/83 |
| 5,929,580 | A | 7/1999 | Mullet et al. | 318/466 |
| 5,998,950 | A | 12/1999 | Fitzgibbon et al. | 318/280 |
| 6,005,361 | A | 12/1999 | Grinewitschus et al. | 318/469 |
| 6,064,316 | A | 5/2000 | Glick et al. | 340/825.31 |
| 6,111,374 | A | 8/2000 | Fitzbiggon et al. | 318/282 |
| 6,118,243 | A | 9/2000 | Reed et al. | 318/468 |
| 6,161,438 | A | 12/2000 | Mullet et al. | 73/774 |
| 6,166,634 | A | 12/2000 | Dean | 340/545.1 |
| 6,209,262 | B1 | 4/2001 | Mathis | 49/28 |

(Continued)

FOREIGN PATENT DOCUMENTS

| | | | |
|---|---|---|---|
| CH | 691 614 | A | 8/2001 |

(Continued)

*Primary Examiner*—Jerry Redman
(74) *Attorney, Agent, or Firm*—Renner Kenner Greive Bobak Taylor & Weber

(57) ABSTRACT

A system for signaling the position of a movable barrier includes a movable barrier; a motor coupled to the movable barrier for moving the movable barrier between limit positions; a position detection device that monitors the movable barrier to generate a barrier position signal; and an indication device that receives the barrier position signal and indicate a position of the movable barrier relative to the limit positions. The system also includes an operation mechanism for controlling the motor and at least one transmitter device which generates a transmission signal received by the operator mechanism to energize the motor. The system further includes a blocking switch which generates a blocking signal received by the operator mechanism to prevent receipt of a transmission signal from a device other than one associated with the indication device.

15 Claims, 4 Drawing Sheets

U.S. PATENT DOCUMENTS 6,246,196 B1 6/2001 Fitzgibbon et al. ..... 318/340
6,326,751 B1 * 12/2001 Mullet et al. ..... 318/434
6,346,889 B1 * 2/2002 Moss ..... 340/686.1
6,481,531 B1 * 11/2002 Nagura et al. ..... 187/247
6,550,586 B1 * 4/2003 Takeuchi ..... 187/391
6,563,431 B1 5/2003 Miller, Jr. ..... 340/932.2
6,597,291 B2 * 7/2003 Tsui ..... 340/686.1

FOREIGN PATENT DOCUMENTS

EP 0 544 135 A 6/1993
EP 0 859 298 A 8/1998

* cited by examiner

SYSTEM AND RELATED METHODS FOR SIGNALING THE POSITION OF A MOVABLE BARRIER AND SECURING ITS POSITION

TECHNICAL FIELD

Generally, the present invention relates to detecting the position of a movable barrier, such as a garage door, as it travels between open and closed positions. More particularly, the present invention relates to a system which obtains and continually represents the positional status of the movable barrier. More specifically, the present invention relates to a system which employs a device to detect a position of the movable barrier and uses either a visual or audio representation to indicate the position of the barrier. And the system includes a feature that blocks wireless signals when it is desired to disable movement of the barrier.

BACKGROUND ART

As is well known, motorized garage door operators automatically open and close a garage door through a path that is defined by an upper limit and a lower limit wherein the limits can be identified electrically or mechanically. The lower limit is established by the floor upon which the garage door closes. The upper limit can be defined by the highest point the door will travel which can be limited by the operator, a counterbalance system, or the door track system's physical limits. The upper and lower limits are employed to prevent door damage resulting from the operator's attempt to move a door past its physical limits. Under normal operating conditions, the operator's limits may be set to match the door's upper and lower physical limits. However, operator limits are normally set to a point less than the door's physical upper and lower limits.

Systems used to set operator limits are composed of switches used to terminate travel in the up and down directions. These mechanical switches are adjustable and can be used by the consumer or an installer to "fit" the door travel to a garage opening. But these switches have a limited life span. Metal fatigue and corrosion are the most likely causes of switch failure. Another drawback of mechanical switches is that they can be wired in series with the motor which creates high current draw across the contacts of the switch causing the contacts to fail. A further limitation of limit switches is that the up and down limits, which must be set manually, can be improperly set or misadjusted.

Other limit systems employ pulse counters that set the upper and lower travel of the door by counting the revolutions of an operator's rotating component. These pulse counters are normally coupled to the shaft of the motor and provide a count to a microprocessor. The upper and lower limits are programmed into the microprocessor by the consumer or installer. As the door cycles, the pulse counter updates the count to the microprocessor. Once the proper count is reached, which corresponds to the count of the upper and lower limits programmed by the consumer or installer, the door stops. Unfortunately, pulse counters cannot accurately keep count. External factors such as power transients, electrical motor noise, and radio interference often disrupt the count allowing the door to over-travel or under-travel. The microprocessor may also lose count if power to the operator is lost or if the consumer manually moves the door while the power is off and the door is placed in a new position which does not match the original count.

As described above, there are a number of methods of determining the travel limits of a garage door. The main concern, consistently addressed, is to determine whether the door is open or is completely closed. One method addresses this with limit switches placed at the upper and lower travel limits of the door. These limit switches can be installed in the doors path or operated off of a reduced travel jackshaft internal to the operator housing. These limit switches can only indicate whether the door is open or not open, or closed or not closed. Such a system cannot indicate where the door is, if the door is neither fully open nor fully closed. There are also magnetic sensors that can send a signal when in close proximity to each other or when the door attracts the magnet due to the door's proximity to the magnet. These devices also are limited to the indication of either the door being closed or not closed. These types of travel limit devices are sometimes connected to indicator lights to give a remote signal as to whether the door is opened or closed and whether the door is not opened or not closed, but no indication is provided as to the door's exact position between the travel limits.

It is foreseeable to use an encoder or pulse counter that is already incorporated into many of these devices to count the rotation of the motor or other rotating components to determine the travel distance of the door and therefore the door's position. But, as noted, these pulse-counting devices can lose count or need to be reset any time power is lost. For example, if a door is closed and power is lost, when the power comes on the operator does not know if the door is open or closed until the motor is started and the door either stalls or begins to move.

The systems and methods generally discussed above are disclosed in the following patents.

U.S. Pat. No. 6,166,634 discloses an improved garage door signaling device comprising a switch actuable upon opening of the garage door, a transmitter actuable by said switch to transmit a signal indicating that the door is open, a receiver located at a desired location remote from the garage door providing an audiovisual warning when the garage door is not in the closed position, and means for energizing the garage door signaling device. However, the audiovisual device provides no specific indication of door position as the door moves.

U.S. Pat. No. 6,161,438 discloses an internal entrapment system for a door movable by a repeatable force that includes a force generating device for transferring the door between a first and a second position. A trolley arm connected between the force generating device and the door is continually strained during movement of the door. A sensor mounted on the trolley arm generates a signal representative of the strain applied to the trolley arm. A processor receives the strain signal for comparison to a predetermined threshold, when the strain signal exceeds the predetermined threshold, the processor at least stops the force-generating device. A potentiometer is coupled to the door for determining a plurality of positional locations of the door between the first and the second positions, wherein the processor correlates the position of the door with the strain signal for use in comparison to the predetermined threshold. A power supply provides electrical power to the force generating device, the sensor, the processor, and the potentiometer, and a decoder/amplifier circuit, which also receives electrical power from the power supply and receives the strain signal for conversion into a format acceptable for use by the processor. However, no external output for indicating door position, via the potentiometer, is made.

U.S. Pat. No. 6,064,316 teaches an access control system that has at least one door associated with a secured area, each door having a strike plate, a host computer, at least one door control module coupled to the host computer, one door control module for every door, and at least one door reader coupled to the door control module to activate the strike plate to release the door. The access control system further has at least one electro-mechanical key to independently actuate a lock that corresponds to the door(s) and a master-keying device to rekey the lock that corresponds to door(s). The host system records information selected from the group consisting of time of entry, place of entry, identification of entered party, and/or any combination thereof. In addition, a door knob and mechanical locking mechanism selectively latches and unlatches the locking mechanism and can be actuated with a mechanical key. The system also includes circuitry to actuate the locking mechanism to selectively latch so that the door can open, wherein the circuitry is actuated by an electrical signal transmitted by an electrical key, and wherein the electrical signal is communicated by an electrical contact extending through the mechanical locking mechanism. The circuitry is powered by a battery, which can be removed without disturbing or actuating the unlocking mechanism. The contact is an insulated electrical wire that extends through the locking mechanism to the circuitry. All of the circuitry discussed can be integrated onto a single, monolithic piece of silicon in a multi-chip or single-chip format. A master-rekeying device has input/output circuitry to receive and transmit electrical signals, and circuitry coupled to the input/output circuitry to record a list of security passwords in order to check passwords against the list and a memory to store data; and the input/output circuitry also receives and transmits electrical signals to a host computer. However, no discussion is provided of a device that blocks an actuation signal to prevent door movement.

U.S. Pat. No. 5,929,580 discloses an internal entrapment system for a garage door operator and includes a motor for transferring a garage door between first and second positions. Also included is a pulse counter for detecting a speed of the garage door during transfer between first and second positions; a potentiometer for determining a plurality of positional locations of the garage door during transfer between first and second positions separate from the pulse counter; and a control circuit for calculating a motor torque value from the speed for each of the plurality of positional locations to compare with a plurality of door profile data points. The control circuit takes corrective action if the difference between the motor torque value for each of the plurality of positional locations and the plurality of door profile data points exceeds a predetermined threshold. The control circuit also updates the plurality of door profile data points to the motor torque values for each respective positional location if the predetermined threshold is not exceeded. In another embodiment both speed and position are detected by a slider element, which is connected to the control circuit. In yet another embodiment a sensor detects non-movement of the door during an open/close cycle and stops operation of the motor. As with the '438 patent, the potentiometer provides no external output for indicating door travel position.

U.S. Pat. No. 5,689,236 teaches a remote garage door position indicator comprising a magnetic sensor device; a transmitter device being operatively coupled to the magnetic sensor device, the transmitter device being capable of transmitting electronic signals; a signal interruption device including a plate extending therefrom, in close orientation to an outer plate of a receiver device engaging the magnetic sensors of the sensor device thereby closing the electrical circuit and causing the transmitter device to cease sending electronic signals; and a garage door position indicator including a power source and a light. The position indicator includes the receiver means capable of receiving electronic signals from the transmitter device. When receiving electronic signals from the transmitter, the receiver device causes the light to illuminate. In the closed orientation the transmitter device does not emit electronic signals thereby preventing the receiver device from illuminating the light. Users can then view the light of the position indicator to determine whether their garage door is opened or closed. However, no intermediate positions of the door are provided by the indicator.

U.S. Pat. No. 5,402,105 discloses a garage door position indicating system includes a tilt switch attached to a garage door, an RF transmitter coupled to the tilt switches, an RF receiver, and an indicator controlled by the RF receiver. The tilt switch supplies an enable signal to the RF transmitter at selected first tilt positions and blocks the enable signal at selected second tilt positions. The RF transmitter generates an RF signal in response to the enable signal. The RF receiver is responsive to the RF signal and controls an indicator to indicate the position of the garage door in either an opened or closed position, but no indication is provided for an indication of an in between position.

U.S. Pat. No. 4,954,810 teaches a signaling system for an automated garage door including a transmitter rendered operative upon the opening of the door and a receiver stage which may be adhesively mounted on the remote sending unit by which door operation is signaled. The receiver stage includes a clock and an audio signal generator both of which are disabled by a reset switch. A bar is adhesively affixed to this reset switch and to the sending unit for common manual articulation of a door closing signal and a reset signal. Nothing in this patent discloses that the receiver may receive a blocking signal to disable operation of the door.

U.S. Pat. No. 4,583,081 teaches a door operator system which includes up and down limit switches actuated to the closed position when the door reaches the up and down travel limits. A processor circuit within the operator is connected to the limit switches for ascertaining the position of the door. Bias circuits apply a bias to the processor when the limit switches are open. An indicator system comprising a pair of light emitting diodes connected across respective limit switches indicates the door position. A series impedance element common to both LED circuits prevents actuation of the control circuit by the light emitting devices. But, like the other references, no teaching is provided of an audio or visual indication of an in between door position.

Based upon the foregoing it is evident that there is a need in the art for a device that can indicate the position of a movable barrier anywhere between an open position and a closed position. Moreover, there is a need for an indication of the movable barrier position by either lights, audible tones or a display to indicate the movable barrier's position. There is also a need in the art for the ability to block out signals from transmitters other than a main indicator device.

DISCLOSURE OF INVENTION

It is thus an object of the present invention to provide a system for signaling the position of a movable barrier comprising a movable barrier; a motor coupled to the movable barrier for moving the movable barrier between limit positions; a position detection device monitoring the movable barrier to generate a barrier position signal; and an indication device to receive the barrier position signal and indicate a position of the movable barrier relative to the limit positions.

It is yet another object of the present invention to provide a module for coupling to an operator mechanism which controls operation of a motor that moves a movable barrier between limit positions, wherein the operator mechanism includes a position detection device that generates a barrier position signal and wherein the module indicates the positional status of the movable barrier, the module comprising a communication circuit capable of exchanging data between the module and the operator mechanism; and an indication device that receives the barrier position signal via the communication circuit and indicates a position of the movable barrier.

Yet still a further object of the present invention is to provide a method of remotely monitoring and controlling the position of a movable barrier comprising detecting a position of the movable barrier between travel limit positions and generating a barrier position signal; and indicating a representation of the movable barrier's position based upon the barrier position signal.

BEST MODE FOR CARRYING OUT THE INVENTION

Figure 1:
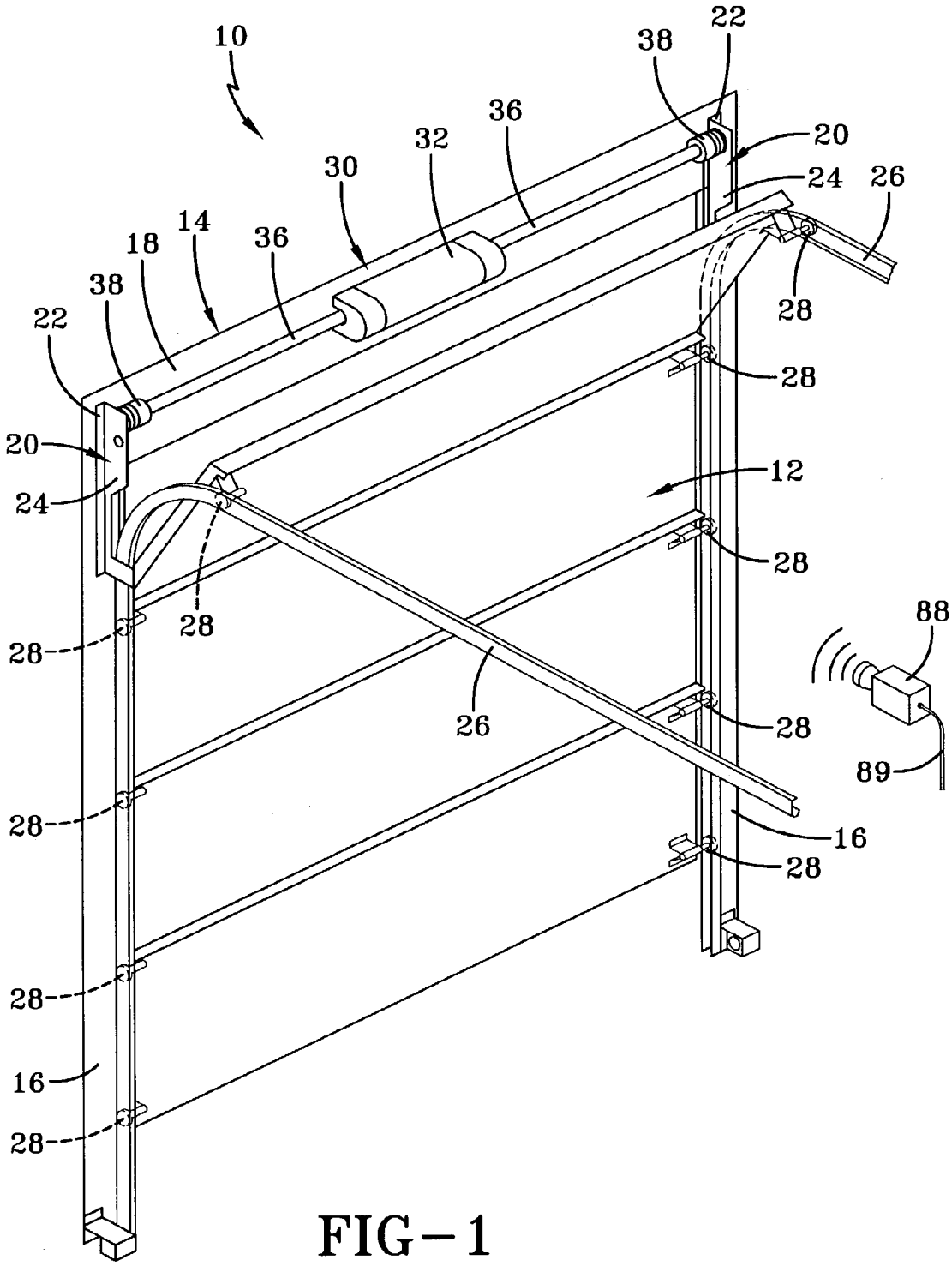
FIG. 1 is a fragmentary perspective view depicting a frame for a sectional garage door and showing an operator mechanism with an internal entrapment system embodying the concepts of the present invention.

A system and related methods for signaling the position of a movable barrier and securing its position is generally indicated by the numeral 10 in FIG. 1 of the drawings. The system 10 is employed in conjunction with a movable barrier such as a conventional sectional garage door generally indicated by the numeral 12. But, the movable barrier may also be in the form of a gate, curtain, awning, rollable shutter or the like. The opening in which the door is positioned for opening and closing movements relative thereto is surrounded by a frame, generally indicated by the numeral 14, which consists of a pair of vertically spaced jamb members 16 that, as seen in FIG. 1, are generally parallel and extend vertically upwardly from the ground (not shown). The jambs 16 are spaced and joined at their vertically upper extremity by a header 18 to thereby form a generally u-shaped frame 14 around the opening for the door 12. The frame 14 is normally constructed of lumber or other structural building materials for the purpose of reinforcement and to facilitate the attachment of elements supporting and controlling the door 12.

Secured to the jambs 16 are L-shaped vertical members 20 which have a leg 22 attached to the jambs 16 and a projecting leg 24 which perpendicularly extends from respective legs 22. The L-shaped vertical members 20 may also be provided in other shapes depending upon the particular frame and garage door with which it is associated. Secured to each projecting leg 24 is a track 26 which extends perpendicularly from each projecting leg 24. Each track 26 receives a roller 28 which extends from the top edge of the garage door 12. Additional rollers 28 may also be provided on each top vertical edge of each section of the garage door to facilitate transfer between opening and closing positions.

Figure 2:
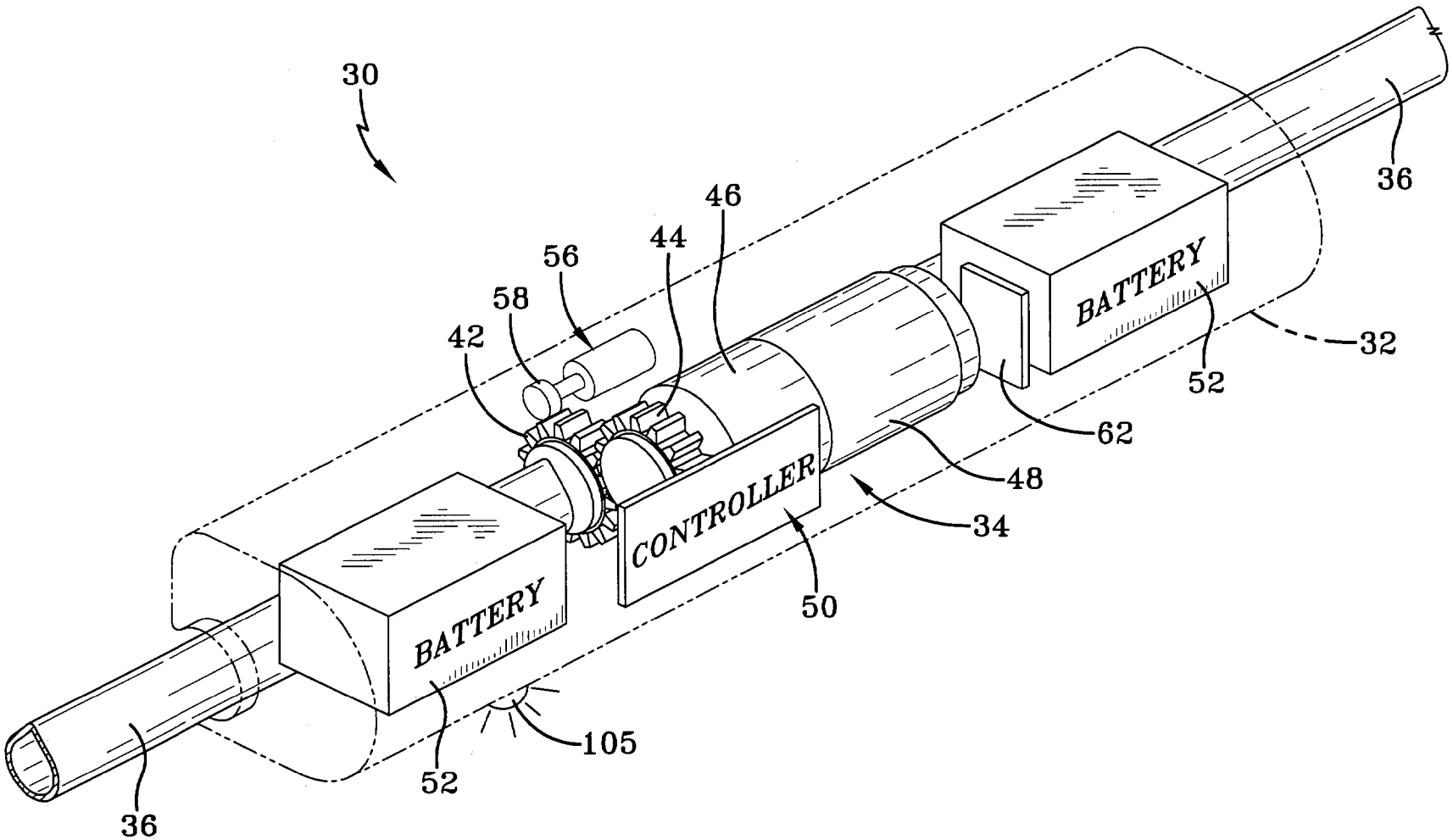
FIG. 2 is an enlarged fragmentary schematic view of the operator mechanism of FIG. 1 as viewed from the inside of the sectional garage door.

A counterbalancing system generally indicated by the numeral 30 may be employed to move the garage door 12 back and forth between opening and closing positions. One example of a counterbalancing system is disclosed in U.S. Pat. No. 5,419,010, which is incorporated herein by reference. Generally, the counter-balancing system 30 includes a housing 32, which is affixed to the header 18 at about a midpoint thereof and which contains an operator mechanism generally indicated by the numeral 34 as seen in FIG. 2. Extending from each end of the operator mechanism 34 is a drive shaft 36, the opposite ends of which are received by tensioning assemblies 38 that are affixed to respective projecting legs 24.

The drive shaft 36 provides the necessary mechanical power to transfer the garage door 12 between closing and opening positions. The drive shaft 36 provides a drive gear 42 at about a midpoint thereof wherein the drive gear 42 is coupled to a motor gear 44. Driving motion of the motor gear 44 is controlled through a gear box 46 by a motor 48 in a manner well known in the art.

A control circuit 50, which is contained within the housing 32, monitors operation of the motor 48 and various other elements contained within the operator mechanism 34 as will be described hereinbelow. Batteries 52 may be connected to the drive motor 48 for the purpose of energizing the motor 48 and the control circuit 50 to provide any power required for the operation thereof. It will be appreciated that the door 12 could be moved by other motorized operators such as a trolley type system.

A potentiometer generally indicated by the numeral 56 is connected to the drive gear 42 for the purpose of generating a barrier position signal which is used to determine positional locations of the door 12. The potentiometer 56 may also be employed to provide a speed value for the garage door as it travels between opening and closing positions. To this end, a slider 58 extends from the potentiometer 56 and is coupled to the drive gear 42 to monitor the positional rotation of the drive gear.

A pulse counter 62 is employed to monitor rotation and speed of the motor 48. The pulse counter 62 may also generate a barrier position signal and is connected to the controller 50 for the purpose of supplying input thereto and allowing the controller 50 to take corrective action when required.

Figure 3:
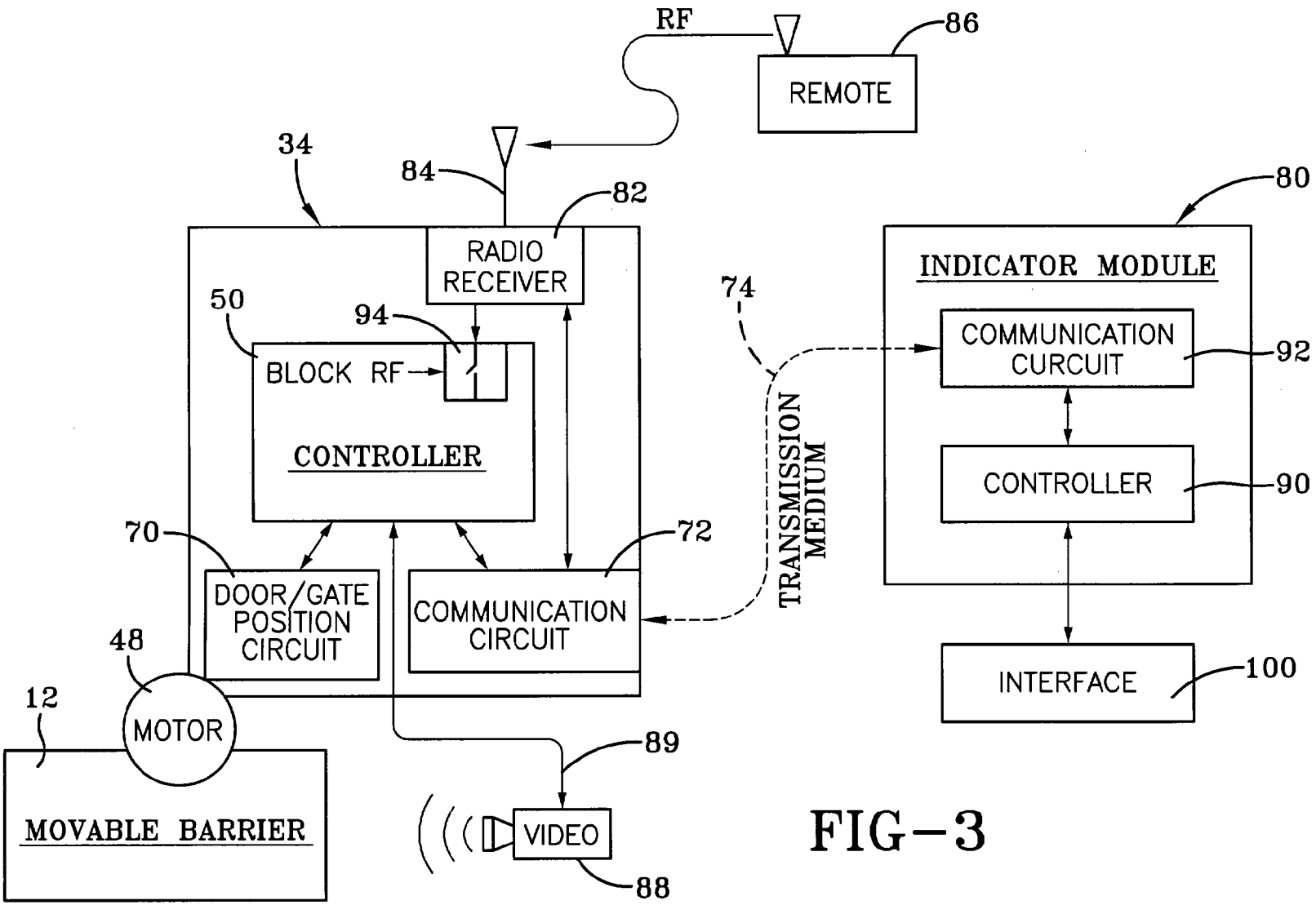
FIG. 3 is a schematic view of a control circuit of the operator mechanism used for controlling operation of the movable barrier and an indicator module which communicates with the operator mechanism.

Referring now to FIGS. 2 and 3, it can be seen that the control circuit 50 employs a controller 50 which receives power from the batteries 52 or from an appropriate power supply. The controller 50 includes the necessary hardware, software—including video processing software—and memory to implement operation of the controller 50. The potentiometer 56 is also connected to the controller 50 wherein it can be seen that the potentiometer includes a first end point and a second end point with the slider 58 disposed therebetween. In essence, the potentiometer 56 is a variable resistor, wherein the two end points have an electrical potential applied across them. If the slider 58 is moved toward the end point with the positive potential, then the slider voltage becomes more positive. If the slider 58 is moved towards the end point with the negative potential, then the slider voltage becomes more negative. By connecting the slider 58 to the door 12 through the drive gear 42, the potentiometer 56 always outputs a voltage relative to the position of the door 12. As noted previously, the potentiometer output voltage can also be used as a barrier position signal. If the power supply, for whatever reason, is removed from the control circuit 50, the slider 58 still points to a position relative to the door 12. If a user moves the door while the operator mechanism 34 is off, the slider 58 maintains a relative position with respect to the door and is reacquired once power is returned to the operator mechanism 34 and the barrier position signal is re-generated.

The operator 34 also includes a position circuit 70 that is connected to the controller 50. The position circuit 70 receives input from the potentiometer 56 and in particular, the voltage output—the barrier position signal—which provides an indication of the door position with respect to the open and close position limits and a direction of door travel between those limits. The position circuit 70 may also receive a barrier position signal from the pulse counter 62, although it is believed that the position information provided by the potentiometer is more accurate. In any event, the controller 50 includes a communications circuit 72 which is connected to the controller 50. The communications circuit 72 receives signals located away from the operator mechanism and the movable barrier and allows for communication with other components that are associated with the overall system. In particular, a link 74 is connected between the communications circuit 72 and an indicator module 80 to allow for the transfer of data and/or signals therebetween. It will be appreciated that the indicator module 80 is preferably positioned out away from the operator mechanism and the movable barrier. In other words, the indicator module 80 is located in a position where a user has access to the module 80 but is not in a position to directly see the operational status of the movable barrier 12. The advantages of such a configuration will be discussed in detail later.

A radio receiver 82 is contained within the controller 50 and has an antenna 84 extending therefrom. The receiver 82 and the antenna 84 allow for receipt of signals from a transmitter 86 which may be either a radio frequency device that is portable or fixed. In other words, the transmitter may be a device that is contained within an individual's automobile or the transmitter may be a device that is associated with a keypad entry device or may be a wall station contained within the room or garage associated with the movable barrier. Alternatively, the transmitter 86 may be an infrared device as long as the communications circuit 72 is configured to receive such a signal. The transmitter may also be directly wired to the communications circuit.

As seen in FIGS. 1 and 3, a video camera 88 has a view of the movable barrier and its various positions. The video camera 88 is mounted in a position to fully view the movable barrier and is in such a position as to not be fully obstructed by movement of automobiles or the like. The video camera 88 generates a video signal 89 which may also function as a barrier position signal. Accordingly, the video camera 88 functions as a position detection device similar to the potentiometer and the pulse counter, and may be considered as a part of the operator mechanism 34. The video signal 89 is sent to the controller 50 which contains the necessary video processing software for formatting the video signal into an appropriate format for transmission by the communications circuit 72.

The indicator module 80 also functions as a transmitter device that communicates with the operator mechanism via the link 74. As will be appreciated, the link 74 may be either a wired or wireless communication link depending upon the particular placement of the indicator module. For example, if the indicator module is contained within a residential house it is conceivable that it could be placed in an upstairs bedroom out of view of the garage or other enclosure. As such, the module could be a wired device, but it is quite conceivable that it could be wireless. In warehouse locations, it is believed that a wireless device would be more convenient to set up so as to avoid the need for running long lengths of wire. In any event, the indicator module 80 includes an indicator controller 90 which includes the necessary hardware, software and memory for communicating with the operator mechanism 34. Moreover, the controller 50 includes the necessary video processing software for relaying the video signal 89 as will be discussed. A communications circuit 92 is connected to the indicator controller 90 and is directly connected to the link 74 for the purpose of transferring data to the operator controller 50.

The operator mechanism 34 also includes a blocking circuit 94 which is contained within controller 50. As will be discussed, the blocking circuit 94 allows for a user of the indicator module 80 to block receipt of any other normally appropriate signals from a transmitter 86 or similar device. Accordingly, the indicator module 80 in conjunction with the circuit 94 may function as a lock to prevent unwanted entry by individuals at times that they are not permitted to enter a warehouse, residence or other establishment.

Figure 4:
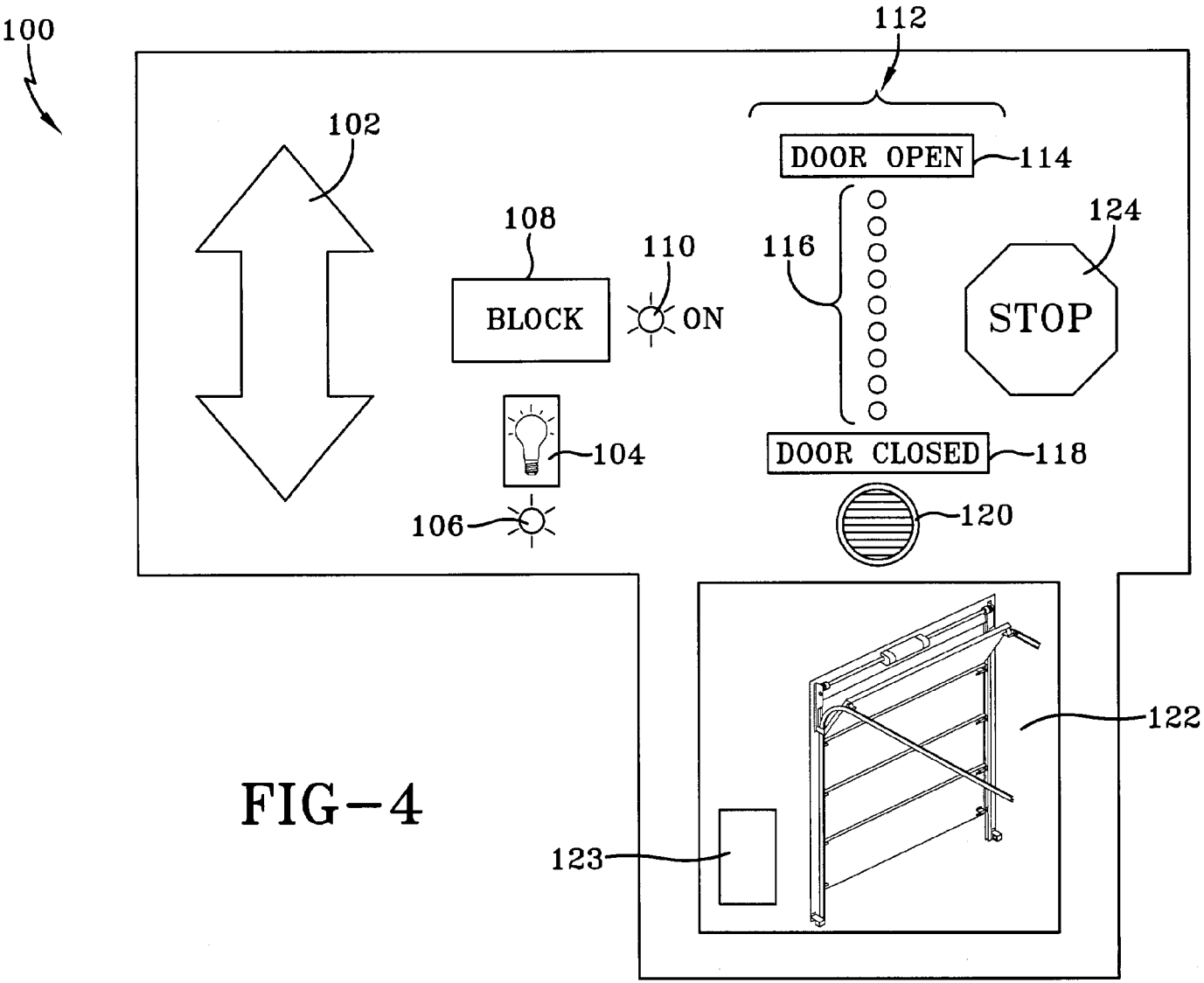
FIG. 4 is a schematic view of an interface device that is linked with the indicator module.

A user interface 100 is coupled to the controller 90 and is best seen in FIG. 4. The interface device 100 includes an up/down button 102. Actuation of the button 102 generates a signal that is received by the controller 50 to move the door from an open position to a closed position or from a closed position to an open position. Of course, the operator mechanism 34 is associated with the necessary entrapment features to ensure the safe operation of the movable barrier. A light button 104 is provided on the user interface 100 and may be used to control operation of a light 105 extending from the housing 30. The user interface 100 also provides a light on/off indicator light 106 to inform the user as to whether the light in the garage is on or off.

The user interface 100 also provides a block button 108 and an associated on/off indicator 110. As previously mentioned, the indicator module 100 is preferably located remotely from the movable barrier and as such actuation of the block button 108 allows that user to prevent other users from entering or exiting the garage door without first reactuating the blocking button 108. In other words, actuation of the block button 108 generates a blocking signal that is transmitted via the controller 90 and the communications circuit 92 to the blocking circuit 94 carried by the operator mechanism 34. When the blocking feature is enabled, any signals received from the transmitter 86 is blocked and the movable barrier is prevented from moving.

The user interface 100 also provides a plurality of position indicators or indication devices 112. The position indicators 112 are used in conjunction with the barrier position signals generated either by the pulse counter 62, the potentiometer 56 or the video camera 88. Based upon the values generated from the barrier position signals a user at the user interface can determine the position of the movable barrier and in what direction it is traveling. In particular, one of the position indicators 112 is a "door open" light 114 that is illuminated whenever the door is at the fully open limit position. A plurality of light emitting or reflecting elements 116 are also provided and these are positioned between the "door open" indicator 114 and a "door closed" indicator 118. The indicator 118 is illuminated whenever the movable barrier is in the fully closed door limit position. The elements 116 interposed between the door open and door closed indicators are provided in such a configuration that they can be illuminated to represent the door position. Accordingly, when a door is fully closed all of the lighting elements 116 are illuminated. When the up/down button 102 is actuated the door travels upwardly and the barrier position signals change accordingly and the lower most lighting element turns off. As the door moves up, the next light would then turn off, and so on. And this change in light element status will proceed as the door moves from the closed to the open position. Conversely, if the door is in the fully open position the lights will illuminate as the door travels down closer to the door closed position. Of course, each of the elements could be configured to turn on as the door travels up, and turn off as the door travels down. It is believed that the number of lighting elements could represent the height of the opening that is closed by the movable barrier. In other words, each light may represent one foot of door travel. It is also believed that more or less lighting elements could be used to convey the same type of information. The light elements may be light emitting diodes, a liquid crystal display or other similar lighting indicia.

Another type of position indicator 112 is an audible or audio speaker 120. The audio speaker 120 could verbally announce the door position on a periodic basis or whenever the up/down button is actuated. For example, a user may press the button 102 and the system would announce "the door is closing." As the door moves through various positions the speaker 120 could announce "ten feet, nine feet, eight feet . . . two feet, one feet, door closed." In this way, the user at the user interface 100 would be able to easily to determine the door position relative, to the open or closed limits. The reverse order could be announced as the door moves from the closed position to the open position. Memory associated with the controller 90 would store all the needed verbal announcements.

Yet another position indicator device 112 may be a video display 122 which allows for display of the video signal 89. Accordingly, the user could directly determine the door position by viewing the video display 122. As part of the video display 122 an inset indicator 123 may be provided. This indicator may provide a numerical distance from the open position or to the closed position to allow for the user to accurately determine how far the movable barrier is from its extreme limits. Moreover, it will be appreciated that the controller 50 includes video processing software that may allow for determination on a frame-by-frame basis as to the door position relative to its normal fully open or fully closed positions. This information could then be used to provide a precise door position that could be displayed in the inset 123.

The user interface 100 may also be provided with a stop button 124. Actuation of the stop button 124 generates a stop signal that is transmitted to the operator controller 50 via the controller 90. Accordingly, as the user receives input from the various position indicator devices they can actuate the stop button 124 to place the movable barrier in a position other than the fully open or fully closed positions. This allows for a user to vent the garage or allow the door to be open a certain amount for pet ingress and egress. Actuation of the up/down button 102 would reverse the direction of the door from the stopped position. It will also be appreciated that actuation of the up/down button 102 during door travel may stop movement of the door which will only recommence upon reactuation of the button 102.

The video display 122 may also include touch screen capabilities. Accordingly, all the switch functions and indicator lights may be part of the touch screen. For example, the up/down button 102, the block button 108, the light button 104, and the stop button 124 may be positioned on the video display 122. And the indicator or status lights 106, 110, 114, 116 and 118 may be positioned on the display in an ergonomic manner. As such, the entire functionality of the user interface 100, except for the speaker 120, may be provided by the display 122.

Based upon the foregoing the advantages of the present invention are readily apparent. The system allows for an indication of the movable barrier's position at any point in the range of the barrier's travel. Accordingly, a user can change the height of the opening for pet access and garage venting without visually seeing the door. Initially, the user interface allows for the user to immediately know whether the door is in a partially closed position as well as the fully opened or fully closed position. The system also allows for an indication of the door position if an obstruction is encountered. Moreover, one can easily determine which direction the door was traveling when contact was made with the obstruction. Use of the blocking device also allows for centralized control of movable barrier to prevent unwanted access by individuals who are no longer permitted to enter through the movable barrier or to prevent access to individual at inappropriate times.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

The invention claimed is:

1. A method of remotely monitoring and controlling the position of a movable barrier, comprising:

coupling a position measuring device to a barrier operator, wherein said position measuring device generates a barrier position signal;

moving the movable barrier between limit positions with said barrier operator;

detecting a position of the movable barrier between travel limit positions by said position measuring device coupled to said barrier operator;

generating a barrier position signal from said position device;

providing a representation by a plurality of position indicators via an interface device, said position indicators identifying the movable barrier's position at various positions between two limit positions based upon said barrier position signal;

coupling a potentiometer to the movable barrier, wherein said potentiometer generates said barrier position signal;

transmitting said barrier position signal to said interface device which performs said first providing step;

providing an up/down button on said interface device, wherein actuation of said up/down button transmits an up/down signal to move the movable barrier; and providing a block button on said interface device, wherein actuation of said block button blocks signals received by said barrier operator from any transmitter, other than actuation of said up/down button so as to prevent movement of the movable barrier.

2. The method according to claim 1, wherein said providing a representation step comprises:

switching on and off at least two lights on said interface device to represent a direction of travel and position of the movable barrier.

3. The method according to claim 2, further comprising:

providing a stop button on said interface device, wherein actuation of said stop button transmits a stop signal to stop movement of the movable barrier.

4. The method according to claim 1, wherein said providing a representation step comprises:

announcing verbally from said interface device a direction of travel and position of the movable barrier.

5. The method according to claim 4, further comprising:

providing a stop button on said interface device, wherein actuation of said stop button transmits a stop signal to stop movement of the movable barrier.

6. The method according to claim 1, wherein said providing a representation step comprises:

displaying a video signal representing the movable barrier's position between two limit positions.

7. The method according to claim 1, wherein said providing a representation step comprises:

displaying a numerical distance from one of said limit positions.

8. The method according to claim 1, further comprising:

coupling a pulse counter to the movable barrier, wherein said pulse counter generates said barrier position signal; and transmitting said barrier position signal to said interface device which performs said providing step.

9. A method of controlling operation of a movable barrier, comprising:

moving the movable barrier between limit positions with a barrier operator;

providing an interface device that communicates with said barrier operator;

providing an up/down button on said interface device, wherein actuation of said up/down button transmits an up/down signal to said barrier operator and initiates movement of the movable barrier; and providing a block button on said interface device, wherein actuation of said block button blocks signals received by said barrier operator from any transmitter, other than actuation of said up/down button, so as to prevent movement of the movable barrier.

10. The method according to claim 9, further comprising:

receiving signals from a remote transmitter by said barrier operator to control movement of the barrier operator; and preventing receipt of signals from said remote transmitter by said barrier operator when said block button is actuated.

11. The method according to claim 10, further comprising:

maintaining positional information in said barrier operator even when said block button is actuated.

12. The method according to claim 11, further comprising:

coupling a potentiometer to the movable barrier, wherein said potentiometer generates said positional information.

13. The method according to claim 11, further comprising:

a pulse counter to the movable barrier, wherein said pulse counter generates said positional information.

14. The method according to claim 9, further comprising:

de-actuating said block button to allow said barrier operator to receive signals from any said transmitter.

15. The method according to claim 9, further comprising:

providing power to said barrier operator regardless of said block button's status.

* * * * *